US006938557B1

(12) United States Patent
Grigsby, Jr.

(10) Patent No.: US 6,938,557 B1
(45) Date of Patent: Sep. 6, 2005

(54) TOP AND FOLDABLE END FRAME ASSEMBLY FOR PALLET CONTAINER

(75) Inventor: John M. Grigsby, Jr., Woodstock, GA (US)

(73) Assignee: North American Container Corporation, Mableton, GA (US)

( * ) Notice: Subject to any disclaimer, the term of this patent is extended or adjusted under 35 U.S.C. 154(b) by 109 days.

(21) Appl. No.: 10/351,655

(22) Filed: Jan. 24, 2003

(51) Int. Cl.[7] ..... B65D 19/00

(52) U.S. Cl. ..... 108/51.11; 108/53.5; 108/53.1; 206/386

(58) Field of Search ..... 108/51.11, 53.1, 108/53.5, 55.1, 55.3, 57.17, 125, 126, 129, 108/130, 131, 132; 248/236.02, 346.3, 336.01, 248/166, 170, 436, 439; 211/195; 206/600, 206/386

(56) References Cited

U.S. PATENT DOCUMENTS

| | | | | |
|---|---|---|---|---|
| 2,905,513 A | * | 9/1959 | Kane | 108/128 |
| 3,033,630 A | * | 5/1962 | Mugler | 108/129 |
| 3,438,343 A | * | 4/1969 | McConnell | 108/53.5 |
| 3,762,343 A | * | 10/1973 | Thacker | 108/53.3 |
| 4,036,361 A | * | 7/1977 | Jacobson et al. | 206/597 |
| 4,832,256 A | | 5/1989 | Grigsby | 229/23 |
| 5,829,189 A | | 11/1998 | Grigsby, Sr. | 217/48 |
| 6,006,676 A | * | 12/1999 | Creek et al. | 108/55.3 |
| 6,250,050 B1 | | 6/2001 | Grigsby, Sr. | 53/452 |
| 6,279,763 B1 | * | 8/2001 | Bush | 211/195 |

OTHER PUBLICATIONS

U.S. Appl. No. 10/015,413, filed Dec. 11, 2001.
U.S. Appl. No. 10/270,785, filed Oct. 11, 2002.

* cited by examiner

*Primary Examiner*—Janet M. Wilkens
(74) *Attorney, Agent, or Firm*—Baker, Donelson, Bearman, Caldwell & Berkowitz

(57) ABSTRACT

A top and end frame assembly (10) attachable to a pallet (12) for packing, shipping, and storing heavy articles, with a pair of stringers (20) made with open-sided U-shaped channels and connected together by transverse members (22, 24). Two pairs of opposing corner posts (50) each formed of an open-sided U-shaped channel pivotally attach at respective opposing distal ends of the stringers (20). Each corner post (50) moves between a folded position with the corner posts received in the respective stringer for shipping in a knocked-down position and an extended position for attaching to a pallet for a frame container. Two pairs of opposing side diagonal members (36) pivotally attach to a respective one of the stringers and move between a received position within the stringer and a diagonal position for pinning at an opposing end to a respective one of the corner posts. The corner posts being pivoted to the extended position attach at distal ends to the pallet (12) for containing heavy equipment.

16 Claims, 5 Drawing Sheets

TOP AND FOLDABLE END FRAME ASSEMBLY FOR PALLET CONTAINER

TECHNICAL FIELD

The present invention relates to frame containers for packing, shipping and storing heavy equipment. More particularly, the present invention relates to top and end frames that connect to pallets for frame containers for packaging, storing, and shipping heavy durable equipment.

BACKGROUND OF THE INVENTION

Heavy durable goods, such as riding lawn mowers, outboard motors, and the like, are typically packaged in single unit containers for packaging, storage, and shipping. Containers useful for enclosing heavy durable goods include wood cleated corrugated paperboard containers, wood cleated crates, and metal frame crates. These containers provide top load capacity, by which vertical loading on the container transfers by side members to the base pallet that holds the heavy durable good. Corrugated paperboard containers also provide protection for the contents from dust and incidental contact. Cleated crates, whether of metal or of wood, are generally open, and so the contents need to be separately enclosed such as with plastic film, sheeting, or the like, to protect from dirt and dust.

One type of single-unit container for packaging such heavy durable goods is a top-frame, cleat-reinforced corrugated paperboard container. The durable goods mount to a pallet which is then enclosed by a corrugated paperboard body. A plurality of vertical reinforcement cleats attach to at least two opposing interior walls of the corrugated paperboard body. The corrugated paperboard body provides definition for the container, protects the durable goods within the container from damage and dust, and maintains the position of the reinforcement cleats. The upper ends of the reinforcement cleats receive a top frame that communicates loading forces through the vertical reinforcement cleats to the pallet. Typically, flaps on the corrugated paperboard body fold over from an upper edge to close the container, although a separate cap may also be used to close the container.

Such corrugated paperboard containers typically are single use, in that after the container is shipped to a sales facility and opened, the container is typically discarded. The corrugated paperboard body readily recycles conventionally. However, most wood components, such as the pallet and top frame typically are discarded in landfills. In use, these containers adequately enclose, support, and protect the goods during handling, storage and shipping. The container costs, however, must be kept relatively low. Manufacturers generally view container packaging as a necessary item, but as not providing a recognized value to the consumer. Further, increased environmental concerns are limiting the use of landfills for disposal of these types of articles.

As an alternative to single use containers, some manufacturers of heavy durable goods are using returnable containers. One such returnable container for heavy durable goods is manufactured with steel framing members. The pallet or base of the container includes projecting lugs at the corners. The lugs receive end panels. The pallet and the end panels interlock with detachable pins.

While these types of returnable container have met with some acceptance, there are drawbacks to their use. Returnable containers generally are more expensive than single use containers. Primarily, this is because returnable containers must hold their form for long periods of time and must withstand many different holdings with forklifts and other mechanical devices. In addition, there are also costs associated with return shipping of the returnable containers, inventory control for tracking and accounting for the containers and the components, and the labor for inspection for damage and for refurbishment of the returnable containers. These associated costs can become significant, and often exceed the cost of a single use container.

Manufacturers of heavy durable goods accordingly have packaging options providing recyclability or returnability. The corrugated paperboard in the corrugated containers are recyclable as noted above, but this restricts the containers to inside storage. Alternative materials such as plastic tends to be excessively expensive for single use container applications. Further, the wood in such corrugated paperboard containers is not a recyclable material. On the other hand, returnable containers made with steel framing members are storable outside under any weather conditions, yet are significantly more expensive in container cost and associated costs. Both the single use and returnable packs generally have desirable characteristics of comprising a minimum number of components or having a relatively small number of fasteners necessary to assemble the containers. For a manufacturer using a container for packaging heavy durable goods, a minimum number of components reduces the handling and labor necessary to receive, store, and assemble containers on a packing line. A relatively small number of required fasteners to assemble a container also reduces the assembly time for packaging the goods. However manufacturers still lack containers that are fully recyclable, can be stored in a variety of weather conditions, and are cost effective for single use containers while eliminating overhead costs associated with returnable containers.

Accordingly, there is a need in the art for an improved shipping container that can withstand the elements of weathering in outside storage as well as be recycled in a mainstream recycling system. It is to such that the present invention is directed.

BRIEF SUMMARY OF THE INVENTION

The present invention solves the above-described problems in the prior art by providing a top and foldable end frame attachable as an assembly to a pallet for packing, shipping, and storing heavy articles thereon, comprising a plurality of spaced-apart stringers connected by a plurality of transverse members, with the outermost opposing stringers comprising open-sided U-shaped channels. Each U-shaped channel includes a flange member medial opposing distal ends and opposing sides of the channel, and the flange member defines a pair of spaced apart openings. Two pairs of opposing corner posts pivotally attach at respective opposing distal ends of the outermost stringers. The corner posts are open-sided U-shaped channels. Each corner post is movable between a folded position with the corner posts received in the respective outside stringer for shipping in a knocked-down position and an extended position for attaching to a pallet for a frame container. Two pairs of opposing side diagonal members pivotally attach at a first end to a respective one of the flanges and move between a received position within the U-shaped stringer and a diagonal position for pinning at an opposing end portion to a respective one of the corner posts. The corner posts being pivoted to the extended position are supported by being connected to the pivoted side diagonals, for attaching the top and corner posts as an assembly to a pallet for containing heavy equipment.

Objects, advantages and features of the present invention will become apparent from a reading of the following detailed description of the invention and claims in view of the appended drawings.

DETAILED DESCRIPTION

Figure 1:
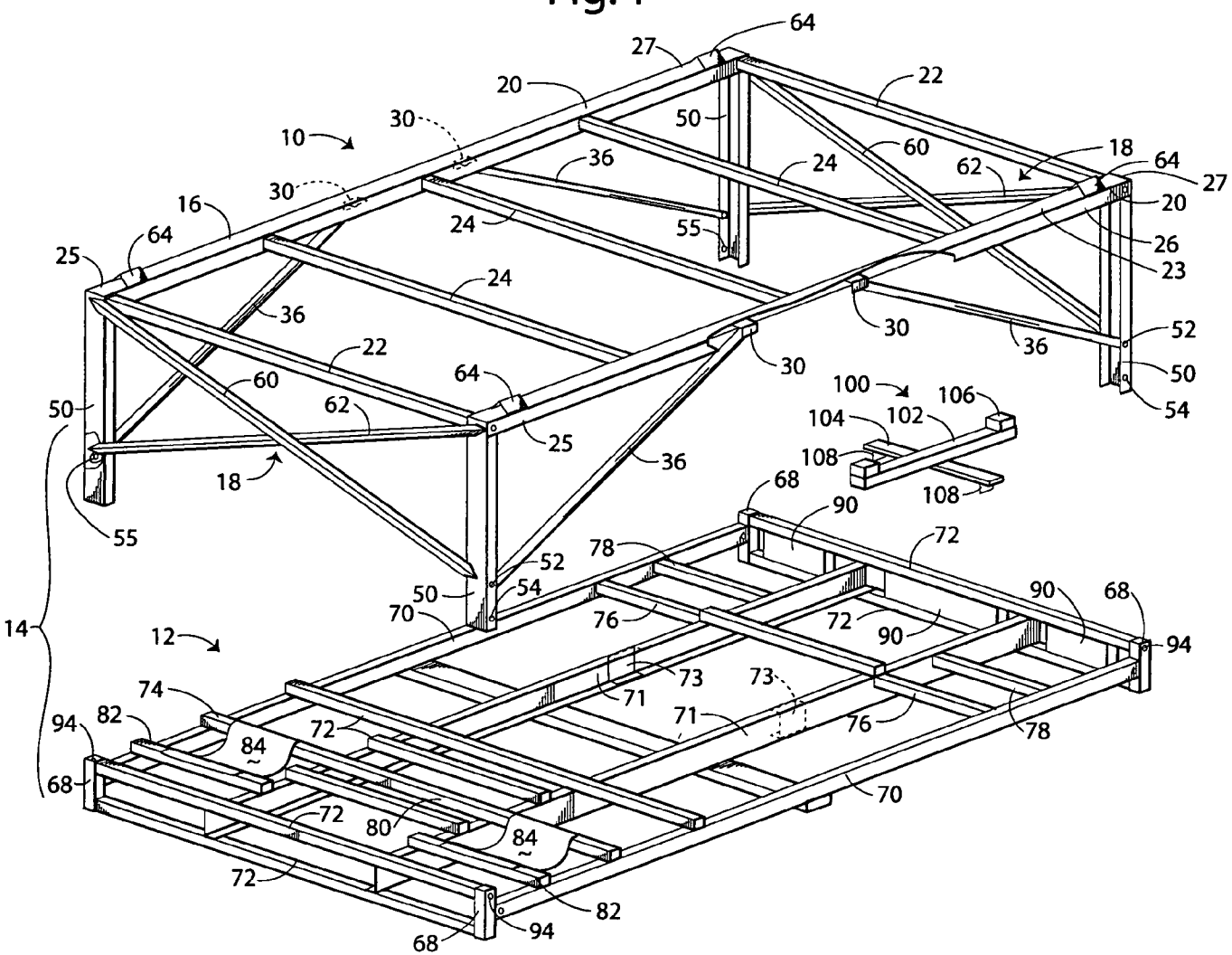
FIG. 1 illustrates in perspective view a top and end frame assembly according to the present invention exploded from a pallet for a frame container for packaging, storing, and shipping heavy durable goods.

Referring now in more detail to the drawings, in which like numerals indicate like parts throughout the several views, FIG. 1 illustrates in perspective view a top and end frame assembly 10 according to the present invention and exploded from a pallet 12 for use in a frame crate generally 14 for packaging, storing, and shipping heavy durable goods, such as a wheeled lawn and garden tractor. The top and end frame assembly 10 comprises a top frame generally 16 and two opposing end frames generally 18. The top frame 16 includes a pair of spaced-apart stringers 20, which interconnect with spaced-apart transverse members 22, 24. The stringers 20 are open-sided U-shaped channels having a back 23 and opposing side walls 26 with opposing distal ends 25, 27. The "open" side of the stringers 20 face towards the pallet 12. The outer transverse members 22 are angle members. The inner transverse members 24 are angle members inverted to provide an apex 28 pointing in a vertical upward orientation so that the "open" side of the angle member faces towards the pallet 12. Other elongate members may be readily used, for example, rectangular tubes, for the inner transverse members 24.

Figure 2:
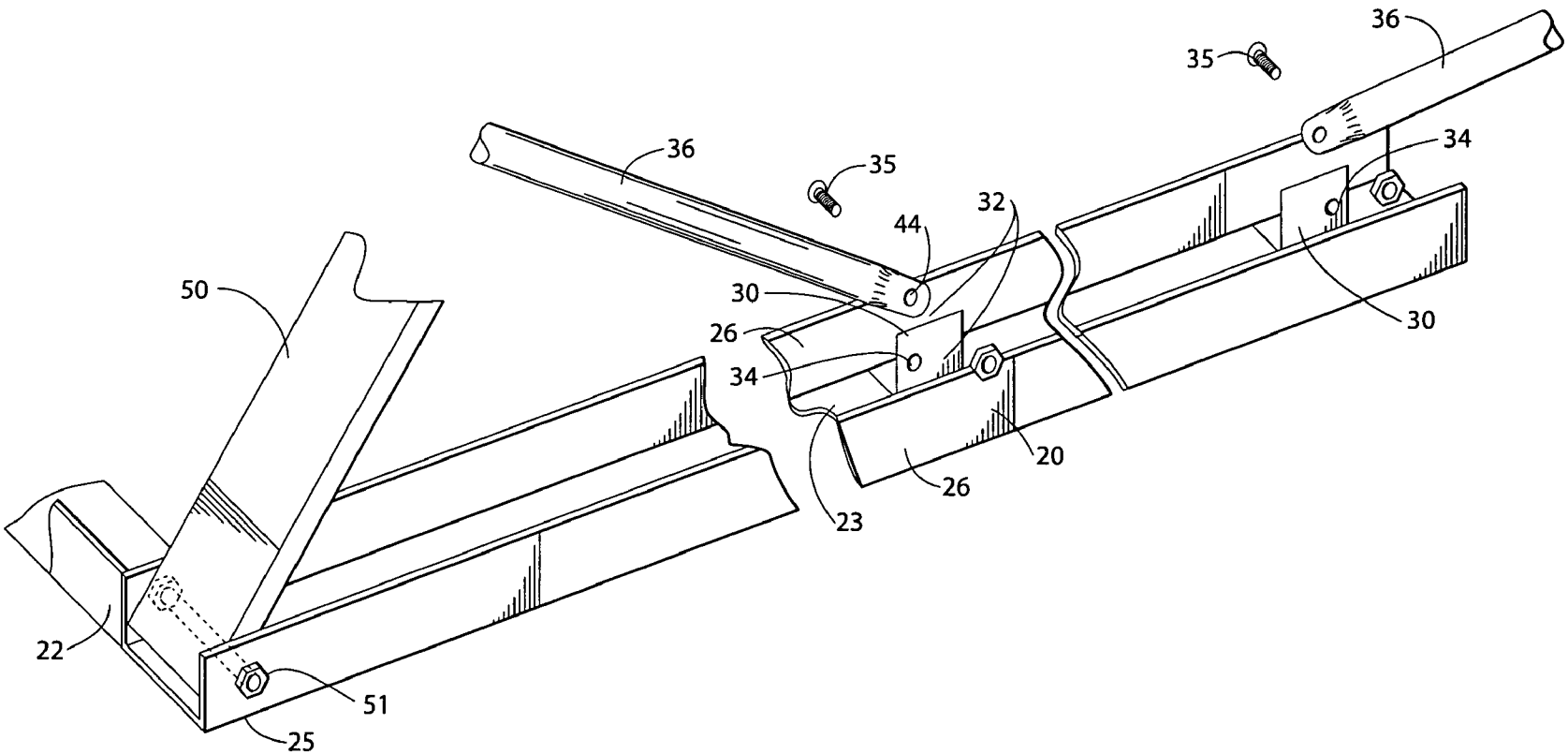
FIG. 2 illustrates in perspective view a stringer used in the top and end frame assembly illustrated in FIG. 1 inverted to show details of an attached corner post and side diagonal.

With reference to both FIGS. 1 and 2, a pair of flanges 30 extends from each stringer 20. FIG. 2 illustrates in perspective view one of the stringers 20 used in the top and end frame assembly 10, with the stringer inverted to show details of an attached corner post 50 and side diagonal 36, discussed below. Each of the flanges 30 comprise an L-shaped angle member. One side fastens, such as by welding, to an interior face of the U-shaped channel intermediate the opposing distal ends 25, 27. The other side of the angle member extends therefrom parallel to and generally medial the opposing sides 26. The flanges 30 thereby define opposing interior spaces generally 32 in the stringer 20 between the flange and the sides 26. Each of the flanges 30 define an opening 34. A pin 35, such as a rivet, extends through the respective openings 34. Two opposing side diagonals 36 pivotally attach at first ends to the respective pin 35. An alternate embodiment uses one elongate flange 30 in each stringer 20, which elongate flange defines openings in opposing distal ends. This embodiment however requires more precision in placement in the stringer and placement of the openings so that the side diagonals 36 hold the corner posts perpendicular to the stringer during use as discussed below so that the container is "square" while holding the goods.

Figure 4:
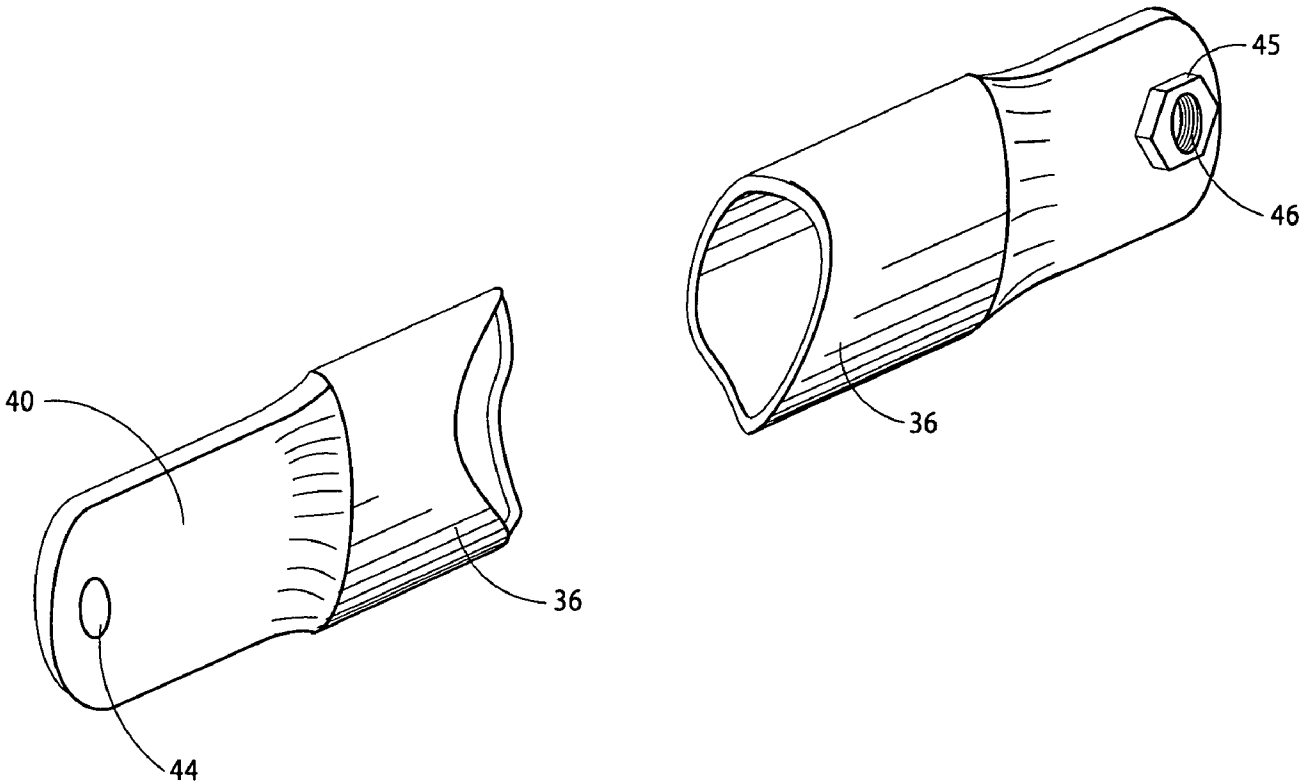
FIG. 4 illustrates in perspective exploded view a detail of a connection of a corner post in the top and end frame assembly to a connector on a pallet.

As best illustrated in FIG. 4, the side diagonal 36 is a cylindrical member with opposing flattened ends 40, 42 which define respective openings 44, 46. A nut 45 attaches coaxial with the opening 46. The pin 35 extends through the opening 44 and the respective opening 34 in the flange 30 to attach the side diagonal 36 to the flange 30 in the stringer 20. The side diagonals 36 pivot relative to the pin 35 between a received position in the respective space 32 of the stringer 20 and an extended diagonal position, as discussed below.

With continuing reference to FIGS. 1 and 2, a corner post 50 pivotally connects to the respective distal ends 25, 27 of each stringer 20 with a threaded bolt or other fastener 51 extending through openings in the sides of the channel and the corner post 50. The corner posts 50 are open-side U-shaped channels. The side walls of the channel are dog-eared at the distal ends at which the corner posts 50 connect to the stringers 20 to facilitate pivoting. The corner posts 50 pivot between a folded position with the corner posts received in the respective outside stringer 20 for shipping in a knocked-down position and an extended position for attaching to the pallet 12 for the frame crate 14. Accordingly, the U-shaped channels defining the corner posts 50 are disposed with the "open" side facing inwardly generally towards the opposing corner post on the stringer.

In the illustrated embodiment, the side wall of the corner post 50 outwardly of the crate 14 defines an opening 52 intermediate the opposing distal ends. The opposing end 42 of the side diagonal 36 connects to the corner post 50 with a fastener, such as a bolt that passes through the aligned openings 52 and 46 and thereby threadably engages the nut 45 on the side diagonal 36. Packing personnel readily install the bolts using air impact drills from outwardly of the container. This also facilitates the "inside width" of the container without changing the overall outside width. The opening 52 may however be defined on an inside wall of the corner post 50.

A distal end of the corner post 50 defines an opening 54 in an outward side to receive a fastener when connecting the top and end frame assembly 10 to the pallet 12, as discussed below. A nut 55 attaches to an inside face of the end wall of the corner post 50 about the opening 54.

The end frames 18 comprise the respective opposing corner posts 50 interconnected by members 60, 62. The members 60, 62 cross diagonally and attach at distal ends to the corner posts 50 and at the central crossing. The members 60, 62 are made of metal strips with a longitudinal rib for stiffening.

A stacking connector 64 attaches to the back 23 of the stringers 20 at the distal ends 25, 27. In the illustrated embodiment, the stacking connector 64 is a wedge-shaped angle member.

The pallet 12 may be any conventional pallet provided with mating corner receiving members 68 for engaging the distal ends of the respective corner posts 50. In the illustrated embodiment, the pallet 12 includes a plurality of spaced-apart parallel outer stringers 70 and inner stringers 71. The illustrated embodiment is made of metal roll-form members and tubes. The stringers 70, 71 are roll-formed box channels. Some loadings carried in the crate 14 may need U-shaped reinforcements 73 that rigidly connect in spaced-apart relation in the inner stringers 71. The stringers 70, 71 interconnect with spaced-apart end cross members 72. Other transverse members 75 interconnect the stringers for rigidity and for accommodating a particular heavy durable good on the pallet. The illustrated embodiment is configured for a wheeled garden tractor, and includes a front wheel support frame generally 74 and spaced-part rear wheel supports 76, 78. The front wheel support frame 74 includes a transverse member 80 with spaced-apart wheel supports 82 connected by arcuate wheel pans 84. In this embodiment, end panels 90 close the gaps defined by the stringers and the cross members 72 at one end of the pallet to prevent entry of forks of a lift truck. Each of the receiving members 68 defines an opening 86 for receiving a pin to interconnect in a lower distal portion with the corner posts 50, as discussed below.

Figure 3:
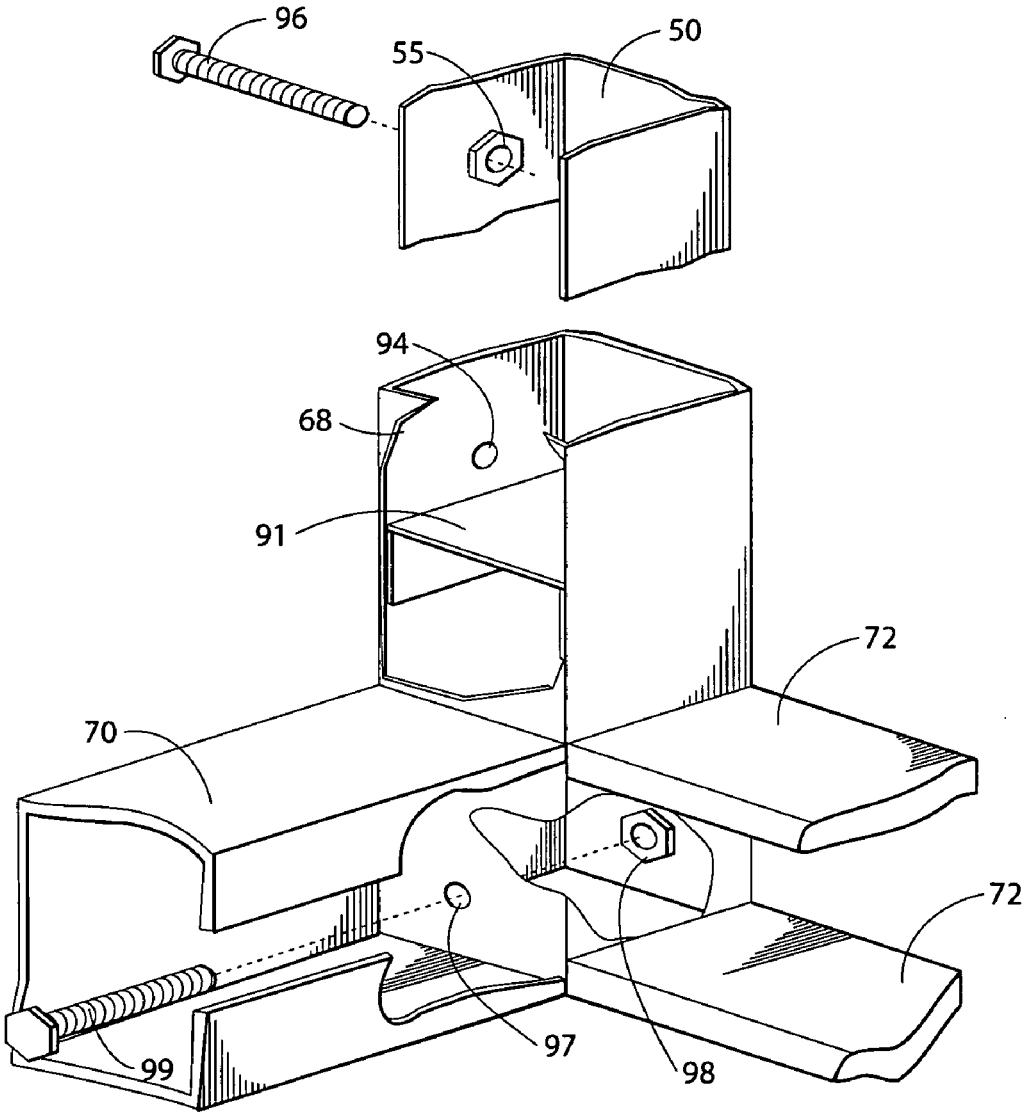
FIG. 3 illustrates in perspective view a side diagonal used in the top and end frame assembly illustrated in FIG. 1.

With reference to FIG. 3, each of the receiving members 68 includes a U-shaped support 91 fixed on an interior of the tubular member 68. Openings (not illustrated) in the side walls allow the legs of the support 91 to be spot welded to the member 68. An outward wall of the receiving member 68 defines an opening 94 that aligns with the opening 52 when the member 68 receives the corner post 50. When this is done, a threaded bolt 96 extends through the opening 94, the aligned opening 54 of the corner post 50, and threadably engages the lock nut 55, for securing the corner post 50 of the top frame 10 to the pallet 12. (In an alternate embodiment, the opening 54 is defined in the web of the corner post 50 with the nut attached on the inner surface thereof, and the opening 94 is defined in the outward wall of the receiving member 68 for aligning the openings.)

The illustrated embodiment includes an optional connection for joining stacked crates 14. A lower end of the member 68 defines an opening 97 and a nut 98 attaches in alignment to an opposing inner surface. A threaded bolt 99 passes through the opening 97 and engages the nut 98 when interconnecting stacked frame crates 14, as discussed below. An alternate embodiment does not use the nut 98 and bolt 99, but rather uses a clevis pin extending through aligned openings to join the stacked crates 14.

Figure 5:
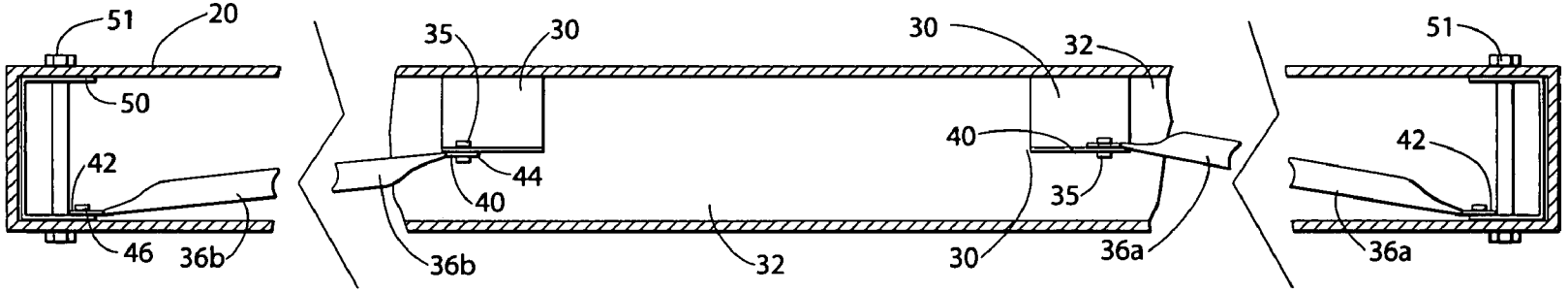
FIG. 5 illustrates a cut-away top view of a stringer in the top and end frame assembly.

FIG. 5 illustrates in cut-away top view one of the stringers 20 in the top and end frame assembly 10 with the opposing corner posts 50 at extended position for forming the frame crate 14. The side diagonals 36 attach on opposing sides 32 to the flange 30 and the opposing corner posts 50. The side diagonals 36 disengage from their respective connections to the corner posts 50 and pivot into the opposing recesses 32 within the stringer 20. The corner posts 50 pivot into the stringer 20 enclosing the respective side diagonals 36 in the knock-down position for shipping and storage.

Figure 6B:
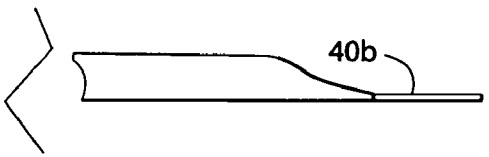
FIGS. 6A and 6B illustrate side views of the flattened ends of the side diagonals.
Figure 6A:
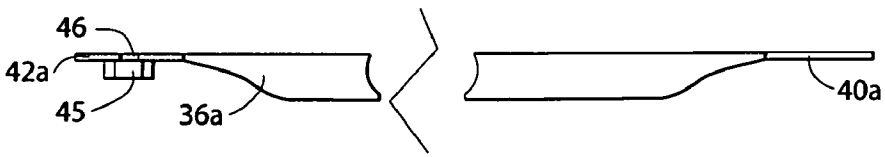

FIGS. 6A and 6B illustrate embodiments of the side diagonals 36*a* and 36*b*. The side diagonal 36*a* has flattened ends 40*a*, 42*a* on the same side relative to a longitudinal axis. The side diagonal 36*b* has flattened ends 40*b*, 42*b* on opposing sides relative to a longitudinal axis. The differing side diagonals 36*a*, 36*b* facilitate metal-to-metal contact at the connections with the flange 30 and the corner posts 50.

The top and end frame 10 of the present invention is used with the pallet 12 for packaging heavy durable goods for storage and shipping. With reference to FIGS. 1 and 5, the article to be packaged is provided to a packing station for placement on the pallet 12. The pallet 12 in the illustrated embodiment is configured for supporting a garden tractor, which is rolled onto the pallet or placed using an overhead hoist, with the front wheels received in the wheel pans 84 and the rear wheels placed in the gaps between the rear wheel supports 76, 78.

With reference to FIG. 1, it may be necessary to provide a carriage support 100 disposed between the pallet 12 and the article carried on the pallet. In the illustrated embodiment, the carriage support 100 is a cross-shaped device supported by the transverse members 75. The carriage support 100 includes a longitudinally extending box channel 102 joined to a transverse box channel 104. In the illustrated embodiment, resilient or rubber cushions or pads 106 attach to an upper surface of the member 102. Angle members 108 connect to lower surfaces of the transverse member 104. The angle members 108 define stops that abut the sides of the inner stringers 71 to position the support 100 laterally on the pallet 12. In the illustrated embodiment of the support 100, the longitudinal and transverse members 102, 104 are 20 gauge steel while the stops 108 are 11 gauge. U-shaped reinforcements 73 may likewise be included (not illustrated) in the carriage support 100.

Continuing with the discussion of packing goods in the crate 14, the top and end frame 10 is removed from a shipping stack and opened for use. This is accomplished by moving the respective end frames 18 from the knocked-down position with the corner posts 50 received within the stringers 20 to the extended position with the corner posts substantially perpendicular to the stringers. The corner posts 50 of a first one of the end frames 18 pivot about the connection 51 with the stringer 20 to the extended position. The associated side diagonals 36 on opposing sides of the pallet 12 then pivot about the connection of the ends 40 with the flange 30 while moving from the space 32 and towards the corner posts 50 in the extended position. The end 42 of the side diagonals 36 connects to the respective corner post 50. A bolt extends through the opening 46 in the side diagonal 36 and the aligned opening 52 in the corner post 50, and engages the nut 53. The associated side diagonal 36 on the opposing side of the top and end frame assembly 10 is similarly pivoted and attached to the opposing corner post 50. The side diagonals 36 help to hold and orient the corner posts 50 substantially perpendicular to the stringer 20 for use, whereby the resulting container of the present invention is substantially square.

This process of pivoting of the end frame 18 with corner posts 50 and the side diagonals 36 and securing the free end of the side diagonals 36 to the respective corner posts 50 repeats for the opposing end frame 18. With the four end posts 50 in extended and secured positions, the top and end frame assembly 10 is rotated and positioned on the pallet 12. With reference to FIG. 3, the receiving members 68 receive the distal ends of the corner posts 50. The distal ends of the corner posts 50 seat on the respective support 91 in the receiving members 68. The bolts 96 extend through aligned opening 94, 54 in the member 68 and the corner post 50, and threadably engage the nut 92.

In an alternate embodiment, the side diagonals pivotally attach to the receiving members 68, such as using the bolt extending through the aligned openings 94 and 54. The opposing end of the side diagonals attach to a side wall of the stringer. In an alternate embodiment, the side diagonals 36 pivotally connect to a side wall of the stringer 20. The side diagonals 36 nest within the stringer until pivoted during assembly of the crate 14 with the corner posts 50 extended perpendicular to the stringer 20. The free distal end of the side diagonals 36 connect to the receiving member 68. These embodiments eliminate the flanges 30.

The crate 14 with its contents is thereafter moved to a warehouse for storage pending sale of the article, or to a truck for shipping the article to an end user. It is to be appreciated that the frame crate containers 14 readily stack. The stacking wedge 64 of a first lower crate 14 receives an open end of the receiving member 66 of a second adjacent one of the containers 14. The stacked crates 14 optionally connect together. The bolt 99 secures the crate 14 together.

The bolt 99 passes through the opening 97 in the member 68 of the upper crate 14, through the stacking wedge 64 of the lower container, and engages the nut 98 in the upper container. In an alternate 15 embodiment, a clevis pen extends through the opening 97 and the stacking wedge 64.

The crate 14 is disassembled by detaching the corner posts 50 from the pallet 12. The foldable top and end frames 18 are folded to the knock-down position by detaching the side diagonals 36 from engagement with the respective corner posts 50. The side diagonals 36 pivot into the opposing recesses 32. The corner posts 50 pivot 20, towards the stringers 20 enclosing the pivoted side diagonals in the spaces 32. The folded top and end frame assembly 10 is stacked with others for return shipment with the pallets for recycling or re-use. Using lightweight but strong materials provides a crate 14 that readily knocks-down ("KD") for shipping in large quantities to a goods manufacturer for use in packing while a smaller overall size allows the manufacturer to place a greater number of the KD containers at the packing station on the assembly line.

To that end, the crate 14 of the present invention readily assembles by the user from the two components—the pallet 12 and the top and end frame assembly 10 provided in knock-down stacks to the user by the crate manufacturer. Packing personnel on the users manufacturing line need a relatively small number of fasteners to secure the side diagonals 36 and to attach the corner posts 50 to the pallet 12. After use, the crate 14 is fully recyclable in mainstream recycling systems which collect steel for melting and fabrication into new steel. The crate 14 provides cost efficiencies and is storable under any weather conditions. The recyclability and single use feature of the present invention allows the use of steel lighter than heavier steel used for returnable containers. For example, but not limitation, the pallet stringers and cross-members are 20 gauge steel; the receiving member 68 and support 19 are 16 gauge steel; the reinforcing piece 73 is 18 gauge steel. The top and end frame 10 has stringers 20 of 18 gauge steel and transverse members 22, 24 of 14 gauge steel. The side diagonals 36 are ¾ inch round tube. The end diagonals 60, 62 are 18 gauge flat strips with a longitudinal rib for rigidity. The corner post is 18 gauge roll formed U-channel. The stacking wedge 64 is 11 gauge steel. The disclosed embodiment is representative of various configurations providing a relatively rigid pallet 12 and top and end frame assembly 10 while minimizing materials cost and providing a crate that is fully recyclable.

This specification has described an illustrated embodiment of the present invention, including the assembly and use for the frame crate 14 with a pallet 12 and the top and foldable end frames 10 in which the end frame assemblies of the corner posts 50 and side diagonals 36 move between and knock-down positions for shipping to an end-user and an assembled or extended positions for containing goods of the manufacturer to be handled, shipped and stored while providing in one embodiment a container that is readily recyclable in conventional steel recycling processes. It is to be understood, however, that numerous changes and variations may be made in the construction of the present container within the spirit and scope of the present invention. It should therefore also be understood that the foregoing specification relates only to the preferred embodiments of the present invention and that modifications and changes may be made therein without departing from the scope thereof as set forth in the appended claims.

What is claimed is:

1. A top frame attachable to a pallet for packing, shipping, and storing heavy articles thereon, comprising:

a pair of spaced-apart stringers connected by a plurality of transverse members, the stringers comprising open-sided U-shaped channels;

two pairs of opposing corner posts each formed of an open-sided U-shaped channel and pivotally attached at respective opposing distal ends of the stringers, each movable between a folded position with the corner posts received in the respective stringer for shipping in a knocked-down position and an extended position for attaching to a pallet for a frame container; and two pairs of opposing side diagonal members, each side member pivotally attached to a respective one of the stringers and movable between a received position within the stringer and a diagonal position for pinning at an opposing end to the corner posts, whereby the top frame, with corner posts being pivoted to the extended position and supported by connecting the pivoted side diagonal members to the corner posts, for attaching to a pallet for containing heavy equipment.

2. The top frame as recited in claim 1, further comprising at least one flange member disposed within each stringer U-shaped channel and defining an opening for pivotally connecting to the side diagonal members.

3. The top frame as recited in claim 1, further comprising:

two transverse members, each connected between the opposing stringers at distal ends thereof; and two pairs of crossed diagonal members, each pair attached to one of the pair of opposing corner posts, wherein the interconnected pairs of opposing sides posts define end frames pivotable between a knocked-down position for shipping and an extended position for attaching to a pallet.

4. The top frame as recited in claim 1, wherein each stringer further comprises a pair of stacking connectors attached at opposing distal end portions.

5. A frame container for packing, shipping, and storing heavy articles, comprising:

a base pallet having a plurality of spaced-apart stringers connected by a plurality of spaced-apart transverse members;

a top frame having a pair of U-channel stringers interconnected by a plurality of transverse members;

two pairs of opposing U-channel corner posts pivotally connected to respective distal ends of the stringers of the top frame and movable between a folded position with the corner posts received in the stringers and an extended position; and two pairs of opposing side diagonal members, each side member pinned in a first end portion to a respective one of the top frame stringers for pivoting from a received position within the respective stringer and a diagonal position for pinning at an opposing end portion to the respective corner post with the corner posts in the extended position, whereby the corner posts pivoted to the extended position are supported by pinning the opposing end of the side diagonal members pivoted from the stringer and connecting distal ends of the corner posts to the base pallet for containing heavy equipment.

6. The frame container as recited in claim 5, further comprising a plurality of receiving posts, each attached to a respective one of the opposing ends of the outermost stringers on the base pallet, for receiving a lower end of a respective one of the corner posts.

7. The frame container as recited in claim 6, wherein each stringer in the top frame further comprises a pair of stacking connectors attached at opposing distal end portions for alignment of a second frame container in a stack.

8. The frame container as recited in claim 7, wherein the receiving post defines an open end for receiving an aligned one of the stacking connectors of a second frame container in a stack.

9. The frame container as recited in claim 8, wherein the stacking connector is an angle member with an apex distal from the stringer in the top frame.

10. The frame container as recited in claim 5, further comprising support plates attached to a first end portion of the base pallet, for supporting wheels of a mobile vehicle thereon.

11. The frame container as recited in claim 5, further comprising at least one flange member disposed within each stringer in the top frame and defining a respective opening for pivotally connecting to the side diagonal members.

12. The frame container as recited in claim 5, wherein each stringer in the top frame further comprises a pair of stacking connectors attached at opposing distal end portions for alignment of a second frame container in a stack.

13. A frame container for packing, shipping, and storing heavy articles, comprising:

a base pallet having a plurality of spaced-apart stringers connected by a plurality of spaced-apart transverse members;

a top frame having a pair of U-channel stringers interconnected by a plurality of transverse members;

a pair of opposing end frames, each having a pair of opposing U-channel corner posts and interconnected by a pair of support diagonals, the corner posts pivotally connected to respective distal ends of the stringers of the top frame and movable between a folded position with the corner posts received in the stringers of the top frame and an extended position;

two pairs of opposing side diagonal members, each side member pinned in a first end portion to a respective one of the top frame stringers for pivoting from a received position within the respective stringer and a diagonal position for pinning at an opposing end portion to the respective corner post of the top frame with the corner post at the extended position, whereby the end frames being pivoted to the extended position are held by pinning the opposing end of the side diagonal members to the respective corner posts and distal ends of the corner posts connect to the base pallet for containing heavy equipment.

14. The frame container as recited in claim 13, further comprising a plurality of receiving posts, each attached to a respective one of the opposing ends of the outermost stringers of the base pallet, for receiving a lower end of a respective one of the corner posts.

15. The frame container as recited in claim 13, further comprising support plates attached to a first end portion of the base pallet, for supporting wheels of a mobile vehicle thereon.

16. The frame container as recited in claim 13, further comprising at least one flange member disposed within each stringer in the top frame and defining a respective opening for pivotally connecting the side diagonal members.

* * * * *